United States Patent [19]

Nichols

[11] 4,063,321

[45] Dec. 20, 1977

[54] CHAIR SUPPORT FOR BOAT MOTOR CONTROLS

[76] Inventor: John H. Nichols, P.O. Box 267, Arnold, Mo. 63010

[21] Appl. No.: 746,860

[22] Filed: Dec. 2, 1976

[51] Int. Cl.[2] ..... B63B 29/00

[52] U.S. Cl. ..... 9/7; 297/429

[58] Field of Search ..... 9/7; 114/153; 115/18 E; 297/423, 429, 430, 431, 433, 434, 435, 436

[56] References Cited

U.S. PATENT DOCUMENTS

| | | | |
|---|---|---|---|
| 2,804,838 | 9/1957 | Moser | 114/153 |
| 2,829,616 | 4/1958 | O'Brien et al. | 114/153 |
| 3,151,910 | 10/1964 | Larson | 9/7 |
| 4,008,500 | 2/1977 | Hall, Jr. | 9/7 |

*Primary Examiner*—Stephen G. Kunin

*Assistant Examiner*—Jesus D. Sotelo

*Attorney, Agent, or Firm*—Paul M. Denk

[57] ABSTRACT

In a support for holding foot operated controls of a boat motor, the support includes an arm that extends approximately forward and aft with respect to a boat mounted fishing chair, the arm is secured to the underside of the fishing chair through the agency of a series of struts, and an adjustment rod further connects to the underside of the fishing chair and to the proximate back end of the arm, and when adjusted, provides for variation in the angular disposition of the arm with respect to the chair, so as to provide structure for the fine adjustment in the disposition of the motor controls with respect to the fisherman located within the chair; a plate is adjustably connected to the other or remote end of the arm, and this plate is designed for accommodating the motor controls thereon.

8 Claims, 5 Drawing Figures

CHAIR SUPPORT FOR BOAT MOTOR CONTROLS

BACKGROUND OF THE INVENTION

This invention relates generally to supports, and more particularly pertains to a support plate useful for holding boat motor controls at an adjustable position a distance from a fishing chair approximating the leg reach of the fisherman.

Various styles of chairs useful for adding to the comfort of the fisherman are readily available in the prior art. For example, one such rather complex chair is shown in the U.S. Pat. to Larson, U.S. Pat. No. 3,151,910, and which chair includes a variety of comforting features such as an adjustable seat back, but more significantly includes an adjustable foot rest upon which the fisherman may rest his lower extremities. The particular chair shown in this patent, as with most fishing chairs of this design, are generally designed for mounting upon the aft portion of ocean going yachts, and more particularly those used in the art of deep sea fishing.

It is, therefore, the principal object of this current invention to provide an accessory for use with a fishing chair and which provides support for any boat motor controls thereby greatly facilitating the fisherman's control of the movement of his boat while freeing his hands for the usual piscatorial maneuvers.

A further object of this invention is to provide a support for use in conjunction with a fishing chair and which can be easily manipulated and adjusted so as to dispose a boat motor control within easy reach of the foot of any fisherman.

Another object of this invention is to provide a support for a foot operated trolling motor control.

A further object of this invention is to provide a support for a trolling motor control and which includes both broad and fine adjustment features so as to facilitate a quick setting in the disposition of the control with respect to the fisherman utilizing its accompanying chair.

Yet a further object of this invention is to provide a support which is easily assembled and fabricated from relatively few components, and which can be installed within a minimum of time.

These and other objects will become more apparent to those skilled in the art upon reviewing the summary of this invention, and upon undertaking a study of the preferred embodiment in view of its drawings.

SUMMARY OF THE INVENTION

This invention relates to an accessory for a chair of the type that may be mounted within a boat and useful for adding comfort to the fisherman while participating in the sport. The accessory includes a support that is designed to provide for the disposition of foot operated controls that can be used for regulating the speed and direction of a boat motor, and particularly a trolling motor. Such a control is available in the art, and is exceedingly useful for easing the task of that particular fisherman within a boat who not only desires to test his skills at fishing, but likewise has been assigned the task of concurrently operating the motor, as when performing that style of fishing customarily known as trolling.

This support includes various interengaged components that not only provide full support for the weight of the motor control, but likewise, any force exerted upon it by means of the urgings of the foot of the boatman. And, these various components provide for a plurality of both major and fine adjustments in the setting of the control with respect to the chair seat, so that it can be quickly and easily reset for that fisherman utilizing its accompanying chair while undertaking the boat motor control task.

These various components include an arm that extends some distance generally horizontally forwardly of the frontal portion of the seat of the chair, and this arm mounts generally to the underside of the said chair by means of a series of struts. There actually are two pairs of such struts supporting the arm with respect to the chair, some distance therebelow, with a front pair of struts attaching to the approximate underside frontal portion of the chair seat, and then extending downwardly therefrom for attachment to either side of the arm. The second pair of struts attach more rearwardly of the chair seat, to its underside, and then likewise extend downwardly where its lower ends are also secured to opposite sides of the said arm. Preferably, but not essentially, these lower arms of the strut will be secured in alignment upon opposite sides of the arm by means of a single fastening means, so that the arm may be pivoted slightly vertically with respect to these struts, with the focal point of the pivoting being at the location of where the fastener secures these lower ends of the struts to the said opposite sides of the arms means.

Further included is an adjustment means comprising a rod that secures through the back end of the arm, and is fastened thereto by means of a pair of nuts that threadedly engage upon the lower end of said rod, and embrace the upper and lower surfaces of the rod, and are tightened thereagainst so as to seat the arm in a particular position. This rod extends approximately upwardly from this back end of the arm, and has its upper end secured to the underside of the chair seat. Thus, by rearranging the fastening nuts provided upon the rod, as by threadedly turning them either upwardly or downwardly with respect to the same, the arm is pivoted about its connection to the lower end of the struts, thereby raising or lowering the opposite end of the said arm, for adjustment purposes.

Securing with the forward end of the arm is a plate, and which plate can be secured at various distances along and forward length of the said arm so as to provide yet another form of adjustment to this particular support. This plate is designed for having affixed to it the aforesaid motor control, and thereby dispose it at a forward and lower position with respect to the chair seat, at approximately within a leg's reach of the same, and thereby make it readily accessible for manipulation by the foot of the fisherman during performance of his piscatorial talents.

DESCRIPTION OF THE PREFERRED EMBODIMENT

Figure 1:
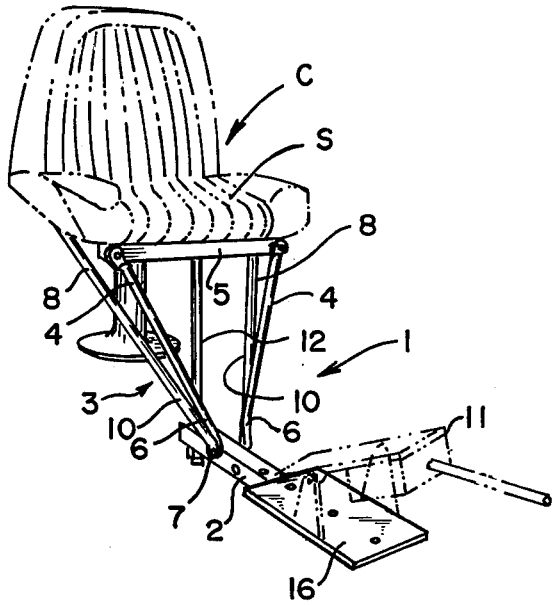
FIG. 1 discloses an isometric view of the fishing chair support of this invention, also disclosing in hidden line the motor control supported by the same.
Figure 2:
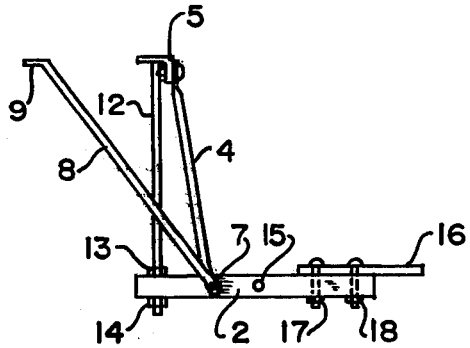
FIG. 2 provides a side view of the control support alone.
Figure 3:
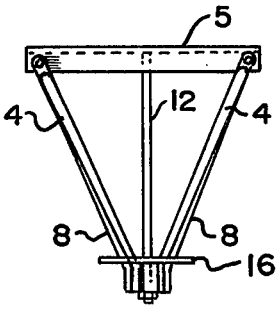
FIG. 3 provides a front view of the said support.
Figure 4:
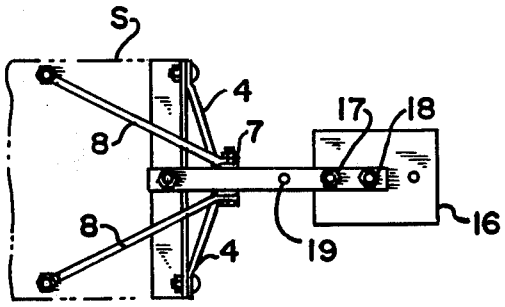
FIG. 4 furnishes an underside plan view of the said support.
Figure 5:
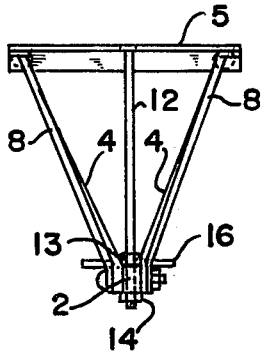
FIG. 5 provides a rear elevational view of the said support.

In referring to the drawings, and in particular FIG. 1, there is disclosed a fisherman's chair C having the usual cushioned seat portion S, and depending downwardly from the underside of said seat is the support 1 of this invention. This support includes an arm means 2 that extends generally in a horizontal direction forwardly of the said chair, and it is supported generally from the underside of its seat by means of a series of struts 3. These struts generally include two pairs of struts, the first pair 4 being secured at their upper ends approximately at the forward portion of the underside of the seat S, and attaches by means of a length of angle 5 to the seat at this location. The lower ends 6 of this pair of struts 4 are secured to opposite sides of the arm 2 by means of a fastener 7. The second pair of struts 8 are attached at their upper ends 9 to the underside of the chair seat, with these ends 9 of the struts 8 being slightly bent so as to provide for their flush mounting by means of a fastener to the underside of the seat, as can be more accurately seen in FIG. 2. The lower ends 10 of this pair of struts 8 are likewise secured to opposite sides of the arm 2, and preferably are aligned with the ends 6 of the pair of struts 4 so that the single fastener 7 can be utilized for securing all of these lower ends of the struts to the arm 2. The reason for this is that securement of the strut ends in this manner provides a focal point for pivoting of the arm 2 with respect to these struts, so as to facilitate its adjustment and use setting. To provide for fine adjustment in the setting of this support, and more particularly its foot or pedal control 11, and adjustment means comprising a rod 12 connects at its upper end to the underside of the seat, and more preferably to the aforesaid angle 5, and extends generally downwardly in a vertical direction for projecting through an aperture provided proximately through the back end of the arm 2, as can be seen. A pair of fastening means, generally the nuts 13 and 14, are threadedly engaged to this lower end of the rod 12, and when a fine setting has been made in the disposition of the arm 2, as when the control 11 has been arranged at the position deemed most comfortably within a leg's reach of the chair user, then the various nuts 13 and 14 can be secured tightly against the upper and lower surfaces of the arm 2, so as to fix the arm, and its supported motor control 11, in place. Obviously, by loosening of the nuts 13 and 14, and by providing for simultaneous raising or lowering of the same upon the rod 12, the arm 2 may be pivoted about its focal point around the fastener 7.

A major adjustment in the setting of the control 11, with respect to the chair, can be achieved through a rearrangement of these struts 3 with respect to the arm 2. This can be achieved by repositioning the lower ends of the struts along the length of the arm 2, and it can be seen that an additional aperture(s), such as the aperture 15, is provided for securement of the fastener 7 therethrough, and thereby affixing the strut ends at this position to opposite sides of the said arm 2. Obviously, by shifting the struts to this new position, it can be seen that the arm 2 will be elevated substantially at its forwardmost end thereby bringing the motor control 11 into a much closer proximity with respect to the chair seat, as when a fisherman of shorter height may be controlling the motor.

Provided at the frontal end of the arm 2 is a plate 16, and this plate is secured by means of a pair of fasteners 17 and 18 disposed through the plate and the arm simultaneously and secured thereto. In addition, it can be seen that there are other apertures disposed vertically through the arm 2, as the aperture 19, and the plate 16 may be shifted rearwardly for securement of its fastener 17 through this aperture 19 so as to again substantially reduce the distance between the motor control 11 and the chair seat.

Variations and modifications of the invention disclosed herein may occur to those skilled in the art upon reviewing the subject matter of this disclosure. Such variations or modifications, if within the spirit and scope of this invention, and encompassed by the claims appended hereto, are intended to be protected by a U.S. patent issuing hereon. The description of the preferred embodiment as heretofore made has been provided for illustrative purposes only.

Having thus described the invention what is claimed and desired to be secured by Letters Patent is:

1. A support for use in cooperation with a fishing chair, and more particularly its seat, and provided for holding a boat motor foot operating control comprising a single arm means, a plate secured to approximately one end of said arm means and disposed for supporting the motor controls thereupon, a series of struts, said struts at their lower ends connecting to the said arm means, said struts at their upper ends connecting to the said chair, and said arm means having an adjustable fulcrum point at the location of its connection to the said struts, whereby the motor controls can be located approximately the length of the user's leg reach from the said chair seat.

2. A support for use in cooperation with a fishing chair, and more particularly its seat, and provided for holding a boat motor foot operating control comprising an arm means, a plate secured to approximately one end of said arm means and disposed for supporting the motor controls thereupon, a series of struts, said struts at their lower ends connecting to the said arm means, said struts at there upper ends connecting to the fishing chair, an adjustment means connecting to the other approximate end of the arm means, said means extending upwardly therefrom and secured to the fishing chair seat, said adjustment means capable of being manupulated for varying the distance between the said arm means and the fishing chair for thereby changing the distance between the motor controls and the said chair seat.

3. The invention of claim 2 wherein said adjustment means comprises a rod, said rod at its upper end securing to the underside of the fishing chair seat, the other end of said rod being threaded and extending through the said arm means, a pair of nuts threadedly engaging upon the said rod, one of each nut provided for bracing and being tightened against opposite surfaces of the said arm for adjusting the disposition of the arm and the plate supported controls with respect to the chair seat.

4. The invention of claim 3 wherein said plate is adjustable in its connection along the length of the said arm means.

5. The invention of claim 3 wherein said series of struts include at least two pairs of struts, one end of each strut of a pair connecting two opposite sides of the arm, one pair of said struts at their opposite ends extending upwardly for connecting proximate the front edge of the under side of said chair seat, and the opposite ends of the other pair of struts extending upwardly for connection rearwardly of the said front edge of the underside of said chair seat.

6. The invention of claim 5 wherein at least one fastener secures the one end of the said struts to the arm means.

7. The invention of claim 6 wherein the fastener is capable of securing the said strut ends to various locations along the length of said support arm means.

8. The invention of claim 5 and including an angle, the upper ends of the one pair of struts connecting to the angle, and said angle being connected proximate the front edge of the chair seat.

* * * * *